United States Patent [19]

Niemond et al.

[11] 4,364,772

[45] Dec. 21, 1982

[54] RAIL WHEEL ALLOY

[75] Inventors: Larry A. Niemond; Michael W. Helwig, Jr.; Thomas J. Connare, all of Lewistown, Pa.

[73] Assignee: Titanium Metals Corporation of America, Pittsburgh, Pa.

[21] Appl. No.: 268,032

[22] Filed: May 28, 1981

[51] Int. Cl.[3] ..... C22C 38/18; C22C 38/40

[52] U.S. Cl. ..... 75/126 R; 75/128 R

[58] Field of Search ..... 75/126 R, 128 R

[56] References Cited

U.S. PATENT DOCUMENTS

| | | | |
|---|---|---|---|
| 1,972,524 | 9/1934 | Kinzel | 75/1 |
| 2,029,819 | 2/1936 | Gregg et al. | 295/30 |
| 2,103,834 | 12/1937 | Tyson | 295/30 |
| 2,247,876 | 7/1941 | Frevert | 295/30 |
| 2,281,850 | 5/1942 | McKinney | 255/28 |
| 2,289,081 | 7/1942 | Shortell et al. | 29/95 |
| 2,395,688 | 2/1946 | Selmi et al. | 75/126 |
| 2,876,095 | 3/1959 | Dickerson | 75/126 |
| 3,078,160 | 2/1963 | Beetle et al. | 75/123 |
| 3,250,610 | 5/1966 | Huber et al. | 75/126 R |
| 3,489,620 | 1/1970 | Current | 148/146 |
| 3,689,329 | 9/1972 | Kern | 148/36 |
| 3,726,724 | 4/1973 | Davies et al. | 75/128 R |
| 3,847,678 | 11/1974 | Furr | 148/2 |
| 3,970,448 | 7/1976 | Wilson, Jr. et al. | 75/128 R |

OTHER PUBLICATIONS

Association of American Railroads, Mechanical Division, Manual of Standards and Recommended Practices, Spec. M-107-77, (1978).

*Primary Examiner*—W. Stallard

*Attorney, Agent, or Firm*—John K. Williamson; James C. Valentine

[57] ABSTRACT

An alloy, particularly adapted for the manufacture of railway wheels, and having an improved combination of hardness, and thus wear resistance, plus resistance to thermal cracking in railway wheel applications; the alloy consists essentially of in weight percent, carbon 0.48 to 0.64, phosphorus 0.05 max., sulfur 0.05 max., manganese 0.60 to 1.10, chromium 0.30 to 0.60, nickel 0.50 max., and balance iron.

9 Claims, No Drawings

RAIL WHEEL ALLOY

BRIEF SUMMARY OF THE INVENTION

In the manufacture of railway wheels and in the selection of alloys for use therein it is necessary to have an alloy that is hardenable to relatively high hardness levels to provide the railway wheels made therefrom with wear resistance. In combination with hardness, however, it is likewise desirable that the alloy exhibit resistance to thermal cracking. This latter property has become of increasing importance in view of the higher freight tonnages being hauled in railway cars and increased impact occurrence with railway wheels due to increasingly poor track condition.

In the prior art including U.S. Pat. No. 2,247,876, and the Association of American Railroads Standard Chemistry for various wheel classes, it has been known to increase hardness by increasing the carbon content of the alloy; however, as carbon is increased the susceptibility of the wheel to thermal cracking is likewise increased. If resort is had to the addition of alloying elements for purposes of hardness the cost of the alloy is increased and, in some instances, such as with the addition of molybdenum and/or vanadium, the desired significant properties of the alloy may also be adversely affected.

It is accordingly a primary object of the present invention to provide an alloy particularly adapted for the manufacture of railway wheels and having for this application an improved combination of hardness and thus wear resistance, plus resistance to thermal cracking without resorting to an increased carbon content to the extent which adversely affects resistance to thermal cracking and without resort to alloying additions that materially affect the cost of the alloy or adversely affect properties significant for railway wheel applications.

A more specific object of the invention is to produce a railway wheel alloy having an improved combination of hardness and resistance to thermal cracking without the inclusion of more than residual amounts of molybdenum and/or vanadium for this purpose. These objects are achieved by an alloy composition within the limits set forth in Table I.

TABLE I

| | Broad | Preferred | Preferred |
|---|---|---|---|
| Carbon | .48 to 64% | .48 to .55% | .57 to .64% |
| Phosphorus | .05 max. | .05 max. | .05 max. |
| Silicon | .40 max. | .10 to .40 | .10 to .40 |
| Sulfur | .05 max. | .05 max. | .05 max. |
| Manganese | .60 to 1.10 | .60 to 1.10 | .60 to 1.10 |
| Chromium | .30 to .60 | .30 to .60 | .30 to .60 |
| Nickel | .50 max. | .50 max. | .50 max. |
| Iron | Balance | Balance | Balance |
| Hardness: Brinell | 285 minimum | 285 minimum<br>341 maximum | 321 minimum<br>363 maximum |

DETAILED DESCRIPTION

Within the composition limits set forth in Table I above the carbon, manganese and chromium in combination provide the desired hardness without requiring carbon to be at levels at which resistance to thermal cracking is adversely affected. Manganese also contributes to deoxidation and the elimination of hot-shorting during forgoing. Nickel in small amounts, less than 0.50 percent, may optionally be added to improve hardenability without sacrificing resistance to thermal cracking and may in this regard permit the attainment of a desired hardness level at a relatively lower carbon content within the limits set forth in Table I.

By way of specific examples to demonstrate the benefits of the alloy of the invention tests were conducted on a 36" diameter railway wheel made from a composition within the scope of the invention and as specifically set forth in Table II. The tests involved 31 simulated emergency stops using a high phosphorus brake shoe, which tests were followed by two separate one hour drag tests using 60 miles per hour speed and a 60 horsepower constant brake force. The wheel of the alloy of the invention showed no evidence of thermal cracking after these tests. Further testing of the wheel under simulated railway applications was performed by conducting 15 simulated emergency stops at 100 miles per hour using a 7,000 pound brake shoe force on the flange of the wheel. Again, no evidence of thermal cracking was observed. Conventional alloys and specifically Class C conventional railway wheel alloys have produced thermal cracks after only one similar simulated emergency stop from 80 miles per hour.

TABLE II

COMPARISON OF THE STANDARD STEEL ALLOY WHEEL TO AAR CLASS B & C WHEELS

| | Mechanical Properties | | | | | |
|---|---|---|---|---|---|---|
| Alloy | BHN | U.T.S. | Y.S. (.2%) | % EL. | % R.A. | CVN (212° F.) |
| Invention | 321 | 139,500 | 110,500 | 15.0 | 37.5 | 30 ft-lbs. |
| Class B | 321 | 149,500 | 106,500 | 15.0 | 43.5 | 10 ft-lbs. |
| Class C | 321 | 147,000 | 106,000 | 15.5 | 32.5 | 15 ft-lbs. |

| | Chemistry | | | | | |
|---|---|---|---|---|---|---|
| Alloy | C | Mn | P | S | Si | Cr |
| Invention | .52 | .97 | .020 | .030 | .31 | .30 |
| Class B | .63 | .84 | .020 | .043 | .25 | .09 |
| Class C | .71 | .72 | .018 | .040 | .28 | .10 |

As may be seen from the data presented in Table II, the alloy of the invention, as compared to the conventional Class B and Class C alloys, exhibits comparable strength with toughness values, as demonstrated by Charpy V notch results superior to these conventional alloys. These improved impact values are, of course, significant in promoting resistance to thermal cracking in rail wheel applications.

It is to be understood that the composition of the invention may include incidental elements such as aluminum and silicon for purposes of deoxidation. For this purpose, for example, silicon may be present to a maximum of 0.40.

Whereas the preferred embodiment of this invention has been described above for the purposes of illustration, it will be apparent to those skilled in the art that variations of the details may be made without departing from the scope of this invention.

I claim:

1. An alloy particularly adapted for the manufacture of rail wheels and having an improved combination of hardness, and wear resistance, plus resistance to thermal cracking, said alloy consisting essentially of, in weight percent, carbon 0.48 to 0.64, phosphorus 0.05 max., sulfur 0.05 max., silicon 0.40 max., manganese 0.60 to 1.10, chromium 0.30 to 0.60, nickel 0.50 max. and balance iron and incidental impurities.

2. The alloy of claim 1 having a minimum Brinell hardness of 285.

3. The alloy of claim 2 in the form of a rail wheel.

4. The alloy particularly adapted for the manufacture of rail wheels and having an improved combination of hardness, and wear resistance, plus resistance to thermal cracking, said alloy consisting essentially of, in weight percent, carbon 0.48 to 0.55, phosphorus 0.05 max., sulfur 0.05 max, silicon 0.15 to 0.40, manganese 0.60 to 1.10, chromium 0.30 to 0.60, nickel 0.50 max. and balance iron and incidental impurities.

5. The alloy of claim 4 having a minimum Brinell hardness of 285.

6. The alloy of claim 5 in the form of a rail wheel.

7. An alloy particularly adapted for the manufacture of rail wheels and having an improved combination of hardness, and wear resistance, plus resistance to thermal cracking, said alloy consisting essentially of, in weight percent, carbon 0.57 to 0.64, phosphorus 0.05 max., sulfur 0.05 max., silicon 0.15 to 0.40, manganese 0.60 to 1.10, chromium 0.30 to 0.60, nickel 0.50 max. and balance iron and incidental impurities.

8. The alloy of claim 7 having a minimum Brinell hardness of 321.

9. The alloy of claim 8 in the form of a rail wheel.

* * * * *